US009417014B2

(12) United States Patent
Liu et al.

(10) Patent No.: US 9,417,014 B2
(45) Date of Patent: Aug. 16, 2016

(54) REFRIGERANT GUIDING PIPE AND HEAT EXCHANGER HAVING REFRIGERANT GUIDING PIPE

(75) Inventors: Huazhao Liu, Hangzhou (CN); Hongzhou Dong, Hangzhou (CN)

(73) Assignees: DANFOSS A/S, Nordborg (DK); SANHUA (HANGZHOU) MICRO CHANNEL HEAT EXCHANGER CO., LTD., Zhejiang Province (CN)

( * ) Notice: Subject to any disclaimer, the term of this patent is extended or adjusted under 35 U.S.C. 154(b) by 307 days.

(21) Appl. No.: 13/822,616

(22) PCT Filed: Jun. 27, 2011

(86) PCT No.: PCT/CN2011/076428

§ 371 (c)(1),
(2), (4) Date: Apr. 24, 2013

(87) PCT Pub. No.: WO2012/034438

PCT Pub. Date: Mar. 22, 2012

(65) Prior Publication Data

US 2013/0199764 A1 Aug. 8, 2013

(30) Foreign Application Priority Data

Sep. 13, 2010 (CN) ..... 2010 1 0282897

(51) Int. Cl.
*F28F 9/02* (2006.01)
*F28F 1/40* (2006.01)
(Continued)

(52) U.S. Cl.
CPC ..... *F28F 1/40* (2013.01); *F25B 39/028* (2013.01); *F28D 1/05316* (2013.01); *F28F 9/0273* (2013.01); *F25B 2500/01* (2013.01)

(58) Field of Classification Search
CPC ..... F28B 39/028; F28F 9/026; F28F 9/0265; F28F 9/0268; F28F 9/027; F28F 9/0273; F28D 1/05316
USPC ..... 165/173–175
See application file for complete search history.

(56) References Cited

U.S. PATENT DOCUMENTS 2,488,615 A * 11/1949 Arnold ..... 138/38
3,229,761 A * 1/1966 Ware ..... 165/142
(Continued)

FOREIGN PATENT DOCUMENTS

CN 101482346 7/2009
CN 101691981 4/2010
(Continued)

OTHER PUBLICATIONS

International Search Report as issued for International Application No. PCT/CN2011/076428, dated Sep. 29, 2011.
(Continued)

*Primary Examiner* — Allen Flanigan
*Assistant Examiner* — Jason Thompson
(74) *Attorney, Agent, or Firm* — Pillsbury Winthrop Shaw Pittman LLP

(57) ABSTRACT

A refrigerant guiding pipe has a pipe wall in which an inner chamber is formed; an opening formed in the pipe wall; and a refrigerant guiding wall portion, at least a part of an edge of the refrigerant guiding wall portion being separated from the pipe wall, thereby forming the opening. The refrigerant guiding pipe can help alleviate generation of non-uniform distribution of refrigerant due to layering of gaseous refrigerant and liquid refrigerant.

20 Claims, 15 Drawing Sheets

(51) Int. Cl.
*F25B 39/02* (2006.01)
*F28D 1/053* (2006.01)

(56) References Cited

U.S. PATENT DOCUMENTS

| | | | | |
|---|---|---|---|---|
| 4,335,782 | A * | 6/1982 | Parker | 165/166 |
| 5,860,595 | A | 1/1999 | Himmelsbach | |
| 6,199,401 | B1 | 3/2001 | Haussmann | |
| 6,729,386 | B1 * | 5/2004 | Sather | 165/110 |
| 6,796,374 | B2 * | 9/2004 | Rong | 165/109.1 |
| 6,863,121 | B2 * | 3/2005 | Menon et al. | 165/158 |
| 2003/0094270 | A1 * | 5/2003 | Holm et al. | 165/166 |
| 2004/0026072 | A1 | 2/2004 | Yi et al. | |
| 2005/0126770 | A1 | 6/2005 | Higashiyama | |
| 2009/0236086 | A1 * | 9/2009 | Higashiyama et al. | 165/176 |
| 2010/0282454 | A1 | 11/2010 | Jiang et al. | |
| 2011/0139422 | A1 | 6/2011 | Oddi et al. | |
| 2013/0192808 | A1 | 8/2013 | Liu | |
| 2013/0213627 | A1 | 8/2013 | Liu | |

FOREIGN PATENT DOCUMENTS

| | | |
|---|---|---|
| CN | 101782297 | 7/2010 |
| CN | 101839590 | 9/2010 |
| CN | 101922882 | 12/2010 |
| CN | 101922883 | 12/2010 |
| CN | 101949663 | 1/2011 |
| JP | 2002-022313 | 1/2002 |
| WO | WO 2012/034436 | 3/2012 |
| WO | WO 2012/034437 | 3/2012 |

OTHER PUBLICATIONS

International Search Report as issued for International Application No. PCT/CN2011/076423, dated Sep. 29, 2011.

International Search Report as issued for International Application No. PCT/CN2011/076419, dated Sep. 29, 2011.

Non-Final Office Action as issued in U.S. Appl. No. 13/822,612, dated Apr. 27, 2015.

Non-Final Office Action as issued in U.S. Appl. No. 13/822,609, dated Apr. 10, 2015.

U.S. Office Action dated Feb. 10, 2016 in corresponding U.S. Appl. No. 13/822,609.

U.S. Office Action dated Nov. 9, 2015 In corresponding U.S. Appl. No. 13/822,612.

U.S. Office Action dated May 13, 2016 in corresponding U.S. Appl. No. 13/822,609.

* cited by examiner

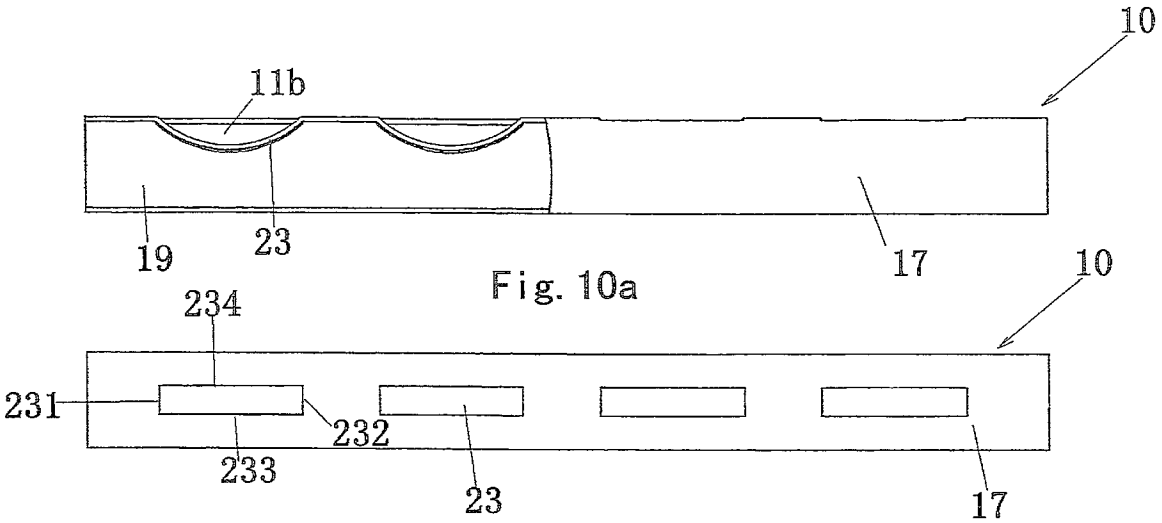
Fig. 10a
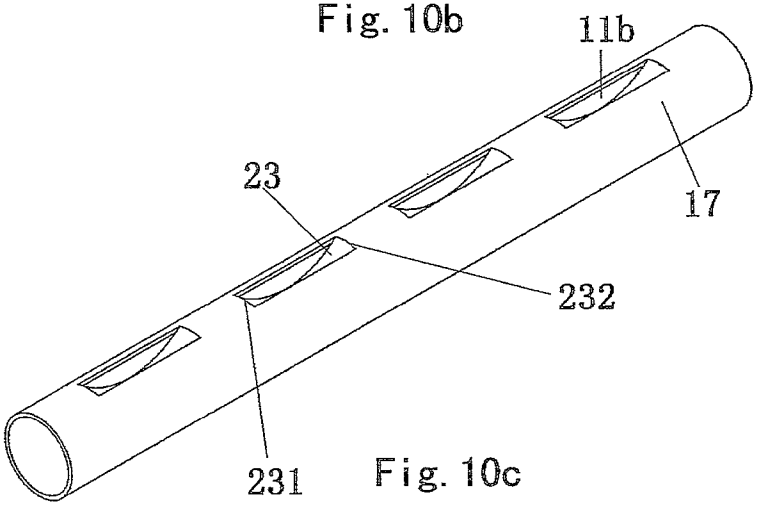
Fig. 10b
Fig. 10c

REFRIGERANT GUIDING PIPE AND HEAT EXCHANGER HAVING REFRIGERANT GUIDING PIPE

FIELD

The present invention relates to a refrigerant guiding pipe and a heat exchanger having the refrigerant guiding pipe.

BACKGROUND

The inlet and/or outlet manifold of a typical heat exchanger is provided with a refrigerant guiding pipe, and the refrigerant guiding pipe is used as a distributor in the inlet manifold and as a collector in the outlet manifold.

SUMMARY

It is desirable, for example, to provide a refrigerant guiding pipe and a heat exchanger with the refrigerant guiding pipe which can improve uniformity of refrigerant distribution.

According to an aspect of the present invention, there is provided a refrigerant guiding pipe. The refrigerant guiding pipe comprises a pipe wall in which an inner chamber is formed; an opening formed in the pipe wall; and a refrigerant guiding wall portion, at least a part of an edge of the refrigerant guiding wall portion being separated from the pipe wall, thereby forming the opening.

According to an aspect of the present invention, at least a part of the refrigerant guiding wall portion is disposed to be substantially inclined with respect to an axial direction of the refrigerant guiding pipe to guide refrigerant passing through the opening, According to an aspect of the present invention, at least a middle portion of the refrigerant guiding wall portion in a direction perpendicular to the axial direction of the refrigerant guiding pipe is positioned at an angle of more than zero degree and less than 90 degrees, desirably from about 5 degrees to about 75 degrees, with respect to the axial direction of the refrigerant guiding pipe; at least a portion of the refrigerant guiding wall portion is positioned at an angle of more than zero degree and less than 90 degrees, desirably from about 5 degrees to about 75 degrees, with respect to the axial direction of the refrigerant guiding pipe; or the refrigerant guiding wall portion is positioned at an angle of more than zero degree and less than 90 degrees, desirably from about 5 degrees to about 75 degrees, with respect to the axial direction of the refrigerant guiding pipe.

According to an aspect of the present invention, at least the middle portion of the refrigerant guiding wall portion in the direction perpendicular to the axial direction of the refrigerant guiding pipe has a section along the axial direction of the refrigerant guiding pipe, and the section is composed of a plurality of substantially straight line-shaped segments or has substantially a shape of a curve; or the refrigerant guiding wall portion has a section along the axial direction of the refrigerant guiding pipe, and the section is composed of a plurality of substantially straight line-shaped segments or has substantially a shape of a curve.

According to an aspect of the present invention, there is provided a heat exchanger with the refrigerant guiding pipe described herein.

With some embodiments of the refrigerant guiding pipe, uniformity of refrigerant distribution can be improved.

BRIEF DESCRIPTION OF THE DRAWINGS

FIG. 10*a* is a schematic front view of a refrigerant guiding pipe according to an embodiment of the present invention;

FIG. 10*b* is a schematic top view of the refrigerant guiding pipe according to an embodiment of the present invention;

FIG. 10*c* is a schematic perspective view of the refrigerant guiding pipe according to an embodiment of the present invention;

DETAILED DESCRIPTION

A further description of the invention will be made as below with reference to embodiments of the present invention taken in conjunction with the accompanying drawings.

Figure 1:
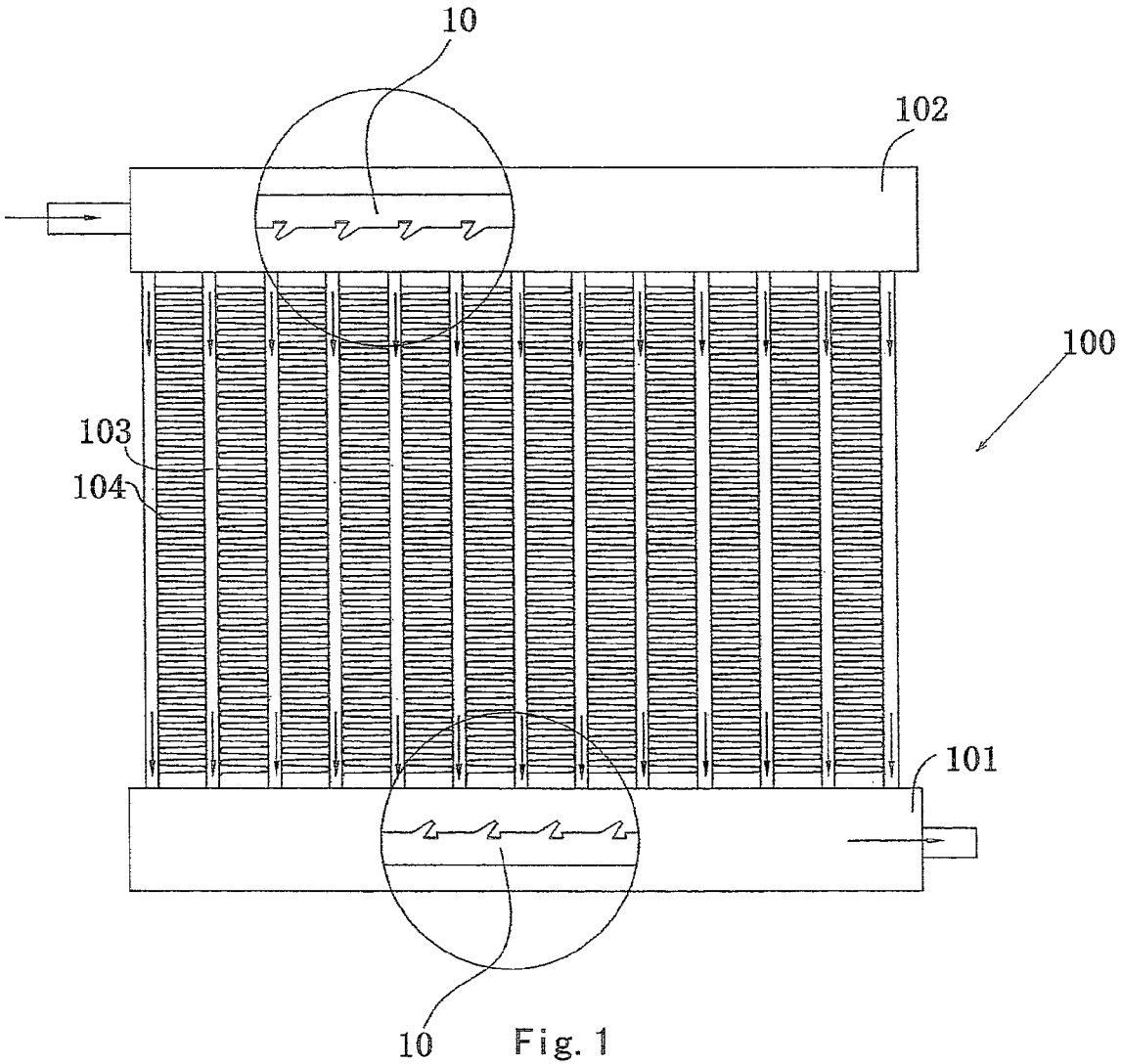
FIG. 1 is a schematic view of a heat exchanger according to an embodiment of the present invention.
Figure 2A:
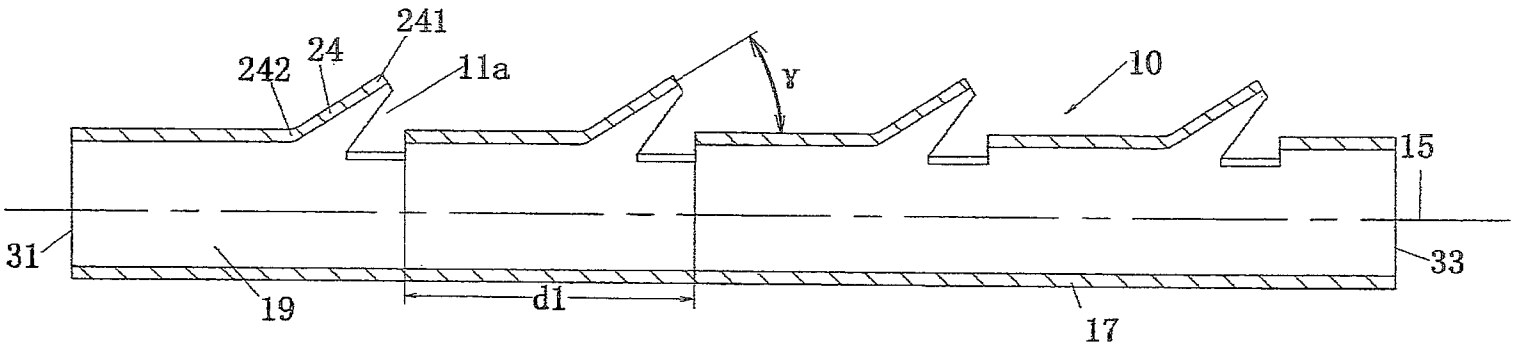
FIG. 2*a* is a schematic sectional view of a refrigerant guiding pipe according to an embodiment of the present invention.
Figure 2B:
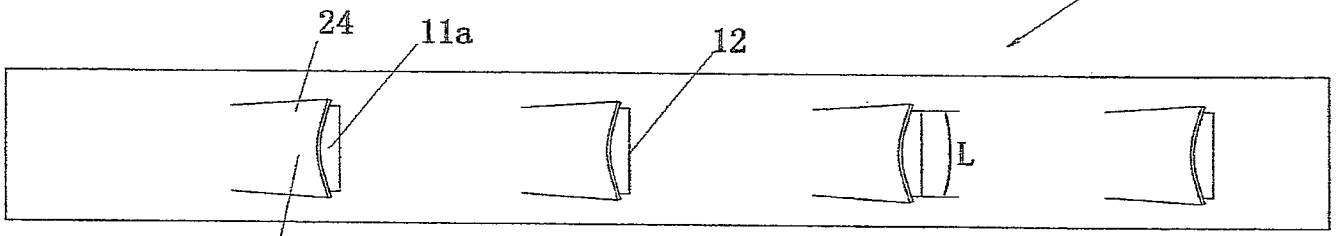
FIG. 2*b* is a schematic view of the refrigerant guiding pipe according to an embodiment of the present invention.
Figure 2C:
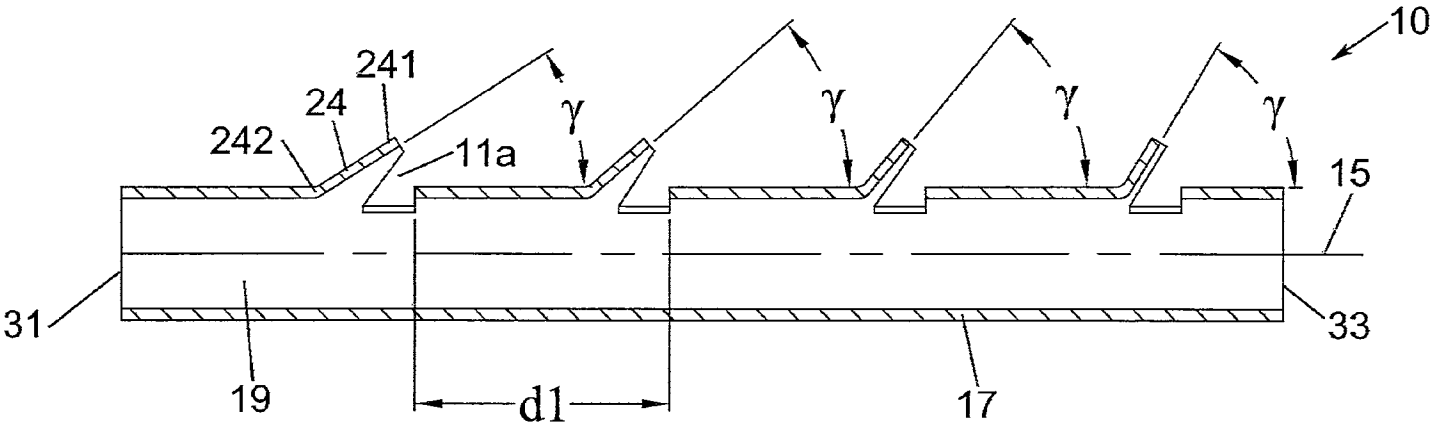
FIG. 2*c* is a schematic sectional view of a refrigerant guiding pipe according to an embodiment of the present invention.
Figure 2D:
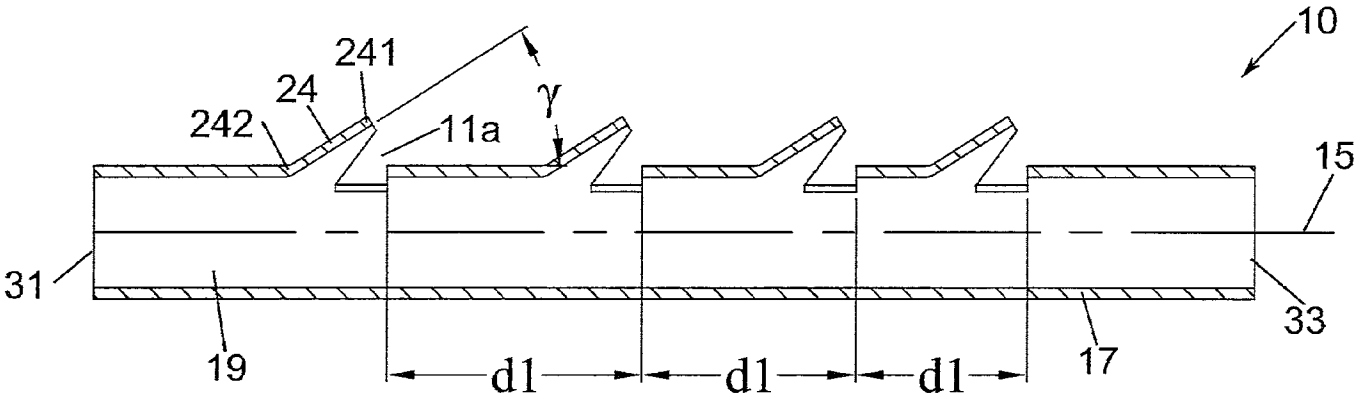
FIG. 2*d* is a schematic view of the refrigerant guiding pipe according to an embodiment of the present invention.

As illustrated in FIG. 1, a heat exchanger 100 according to an embodiment of the present invention comprises a first manifold 102; a second manifold 101 spaced away from the first manifold 102 by a predetermined distance; a heat exchange tube 103 such as a flat tube having two ends respectively connected with the first manifold 102 and the second manifold 101 so that a refrigerant channel in the heat exchange tube 103 is in communication with the first manifold 102 and the second manifold 101; a fin 104; and a refrigerant guiding pipe 10, the first manifold 102, or the second manifold 101, or both the first manifold 102 and the second manifold 101 being provided with the refrigerant guiding pipe 10 therein. The heat exchanger may be any appropriate heat exchanger such as a heat exchanger with one row of core or a plurality of rows of cores or a heat exchanger with one loop or a plurality of loops. In addition, the heat exchanger may be a micro-channel heat exchanger. For example, the refrigerant guiding pipe may be applied to an inner chamber part of an inlet manifold of a plurality of loops of the micro-channel heat exchanger and an inner chamber part of a manifold between the plurality of loops to guide and distribute two-phase refrigerant.

FIGS. 2*a*-2*d* show a refrigerant guiding pipe 10 according to an embodiment. As illustrated in FIGS. 2*a*-2*d*, the refrigerant guiding pipe 10 comprises a pipe wall 17 in which an inner chamber 19 is formed; an opening 11*a* formed in the pipe wall; and a refrigerant guiding wall portion, at least a part of an edge of the refrigerant guiding wall portion is separated from the pipe wall 17, thereby forming the opening 11*a*. At least a part of the refrigerant guiding wall portion is disposed to be substantially inclined with respect to an axial direction of the refrigerant guiding pipe to guide refrigerant passing through the opening 11*a*. The refrigerant guiding wall portion is disposed so that a direction of refrigerant flow flowing through the opening 11*a* is substantially inclined with respect to the axial direction of the refrigerant guiding pipe 10. For example, at least a part of the refrigerant guiding wall portion is positioned at an angle of more than zero degree and less than 90 degrees, desirably from about 5 degrees to about 75 degrees, with respect to the axial direction of the refrigerant guiding pipe. For example, the refrigerant guiding wall portion is disposed such that refrigerant flow flowing through the opening 11*a* is inclined with respect to the axial direction of the refrigerant guiding pipe by an angle of more than zero degree and less than 90 degrees, desirably from about 5 degrees to about 75 degrees.

The refrigerant guiding pipe 10 further comprises a protruded wall section 24 projected outside the inner chamber 19, and at least a first end 241 of the protruded wall section 24 on one side in the axial direction of the refrigerant guiding pipe is separated from the pipe wall 17, thereby forming the opening 11*a*. The protruded wall section 24 constitutes an example of the refrigerant guiding wall portion.

At least a middle portion 24*a* of the protruded wall section 24 in a direction perpendicular to the axial direction of the refrigerant guiding pipe or the protruded wall section 24 is inclined with respect to the axial direction of the refrigerant guiding pipe 10, or at least a portion of the protruded wall section 24 is inclined with respect to the axial direction of the refrigerant guiding pipe 10. A second end 242 of the protruded wall section 24 is closer to an axis 15 of the refrigerant guiding pipe 10 than the first end 241 of the the protruded wall section 24 opposite to the second end 242. The middle portion 24*a* extends from the first end 241 to the second end 242 in the axial direction of the refrigerant guiding pipe 10.

As illustrated in FIGS. 2*a*-2*d*, a method of forming the opening 11*a* is to cut a notch with a certain depth in a pipe wall of a circular pipe for forming the refrigerant guiding pipe 10 in a cutting direction perpendicular to the axial direction of the circular pipe, and then to protrude the pipe wall of the circular pipe on one side of the notch in the axial direction. The opening 11*a* and the protruded wall section 24 are thereby formed. An orientation of the notch is determined by two directions, one of which is a depth direction of the notch (i.e., a direction of the notch in depth) directed in a radial direction of the circular pipe (upward and downward directions in FIG. 2*a*), and the other of which is the cutting direction perpendicular to the depth direction of the notch and the axial direction of the circular pipe. Alternatively, the depth direction of the notch may be positioned at an angle of less than 90 degrees with respect to the radial direction of the circular pipe, and the cutting direction of the notch may be positioned at an angle of less than 90 degrees with respect to the axial direction of the circular pipe. The notch may be any notch in any appropriate orientation.

As illustrated in FIGS. 2*a*-2*d*, a circumferential length of the notch on a circumference corresponding to an inner diameter of the refrigerant guiding pipe 10, i.e., a length of a circular arc of a separated segment 12 at which the first end 241 is separated from the pipe wall 17, is L, and a distance or pitch between the adjacent openings is d1. On the circumference corresponding to the inner diameter of the refrigerant guiding pipe 10, a ratio of the length L of the circular arc of the separated segment 12, at which the first end 241 is separated from the pipe wall 17, to a circumference of a part of the pipe wall 17 corresponding to the separated segment 12 ranges from 0.05 to 0.8. When the refrigerant guiding pipe 10 serves as a distributor, the distances or pitches d1 between the adjacent openings 11*a* may gradually decrease in a direction in which refrigerant flows in the refrigerant guiding pipe 10. Alternatively, the distances or pitches d1 between the adjacent openings 11*a* of the plurality of the openings may be equal to one another.

In an embodiment, at least the middle portion 24*a* of the protruded wall section 24 in the direction perpendicular to the axial direction of the refrigerant guiding pipe 10 has a section along the axial direction of the refrigerant guiding pipe, the section has a shape of a substantially straight line or is substantially straight, and at least the middle portion 24*a* of the protruded wall section 24 in the direction perpendicular to the axial direction of the refrigerant guiding pipe is inclined at an angle γ with respect to the axial direction of the refrigerant guiding pipe 10. Alternatively, the protruded wall section 24 has a section along the axial direction of the refrigerant guiding pipe, the section has a shape of a substantially straight line or is substantially straight, and the protruded wall section 24 is inclined at an angle γ with respect to the axial direction of the refrigerant guiding pipe 10. At least the middle portion 24*a* of the protruded wall section 24 in the direction perpendicular to the axial direction of the refrigerant guiding pipe is positioned at an angle γ of more than zero degree and less than 90 degrees, desirably from about 5 degrees to about 75 degrees, with respect to the axial direction of the refrigerant guiding pipe 10; or the protruded wall section 24 is positioned at an angle γ of more than zero degree and less than 90 degrees, desirably from about 5 degrees to about 75 degrees, with respect to the axial direction of the refrigerant guiding pipe 10.

In an embodiment, when the refrigerant guiding pipe 10 serves as a distributor, the protruded wall sections 24 are designed such that at least the middle portions 24*a* of at least some of the protruded wall sections 24 in the direction perpendicular to the axial direction of the refrigerant guiding pipe or at least some of the protruded wall sections 24 are inclined at the angles γ with respect to the axial direction of the refrigerant guiding pipe 10, and the inclination angles γ may gradually increase in the direction in which refrigerant flows in the refrigerant guiding pipe 10.

The refrigerant guiding pipe 10 with the above configuration may also serve as a collector in the outlet manifold 101.

Referring to FIGS. 1 and 2, whether the refrigerant guiding pipe 10 serves as a distributer in the inlet manifold 102 or as a collector in the outlet manifold 101, an end 31 of the refrigerant guiding pipe 10 will be connected to refrigerant piping but the other end 33 will not be connected to the refrigerant piping. Therefore, the refrigerant guiding pipe 10 may be designed such that the distances or pitches d1 between the adjacent openings 11*a* may gradually decrease in a direction directed from the end 31 of the refrigerant guiding pipe 10 to be connected to refrigerant piping to the other opposite end 33 of the refrigerant guiding pipe 10, that is, from the end 31 to the other end 33; and the refrigerant guiding pipe 10 may be designed such that at least the middle portions 24*a* of at least some or all of the protruded wall sections 24 in the direction perpendicular to the axial direction of the refrigerant guiding pipe or at least some or all of the protruded wall sections 24 are inclined at the angles γ with respect to the axial direction of the refrigerant guiding pipe 10, and the inclination angles γ may gradually increase in the direction directed from the end 31 of the refrigerant guiding pipe 10 to the other opposite end 33 of the refrigerant guiding pipe 10, that is, from the end 31 to the other end 33.

A row of the openings 11*a* or a plurality of rows of the openings 11*a* such as two or three rows of the openings 11*a* are disposed along the axial direction of the refrigerant guiding pipe 10.

The refrigerant guiding pipe 10 may be formed of a circular pipe. The refrigerant guiding pipe 10 may also be formed of a pipe having any other cross section such as an elliptical or rectangular cross section. In addition, the refrigerant guiding pipe 10 may be formed of a pipe having a varying radius. The refrigerant guiding pipe 10 may be formed of any appropriate pipe known in the art.

Referring to FIG. 1, when the above refrigerant guiding pipe 10 is used in the manifold 102 of the heat exchanger 100, refrigerant flows along the inner chamber of the refrigerant guiding pipe, and the protruded wall section 24 mainly functions to guide the refrigerant. The refrigerant is ejected to an inner cavity of the manifold along a surface of the protruded wall section 24 so that resistance loss is low. A part of the refrigerant can be ejected directly into inner chambers of flat tubes 103 and the remaining refrigerant rushes to an end of the manifold 101 and then flows reversely so that refrigerant is uniformly distributed to the remaining flat tubes 103. Refrigerant is mixed in the manifold 101 so that gaseous refrigerant and liquid refrigerant are uniformly mixed and do not layer.

Figure 3A:
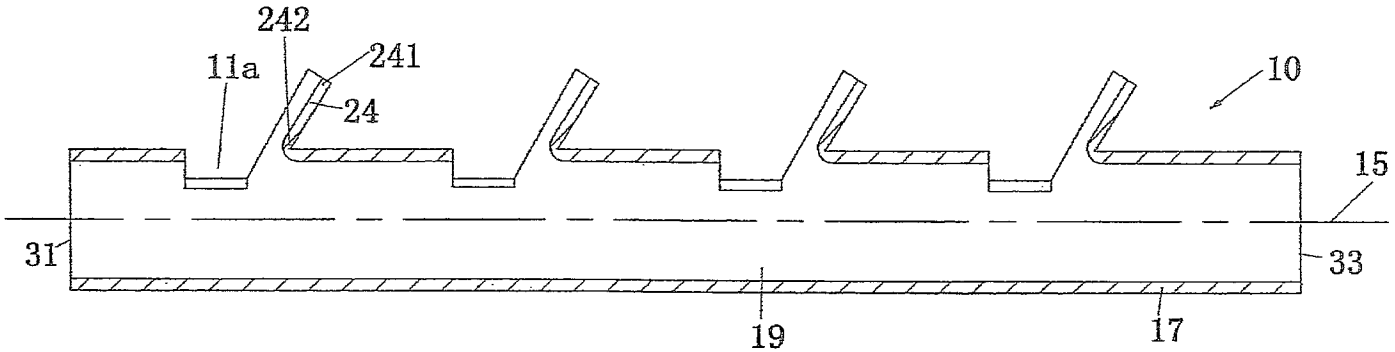
FIG. 3*a* is a schematic sectional view of a refrigerant guiding pipe according to an embodiment of the present invention.
Figure 3B:
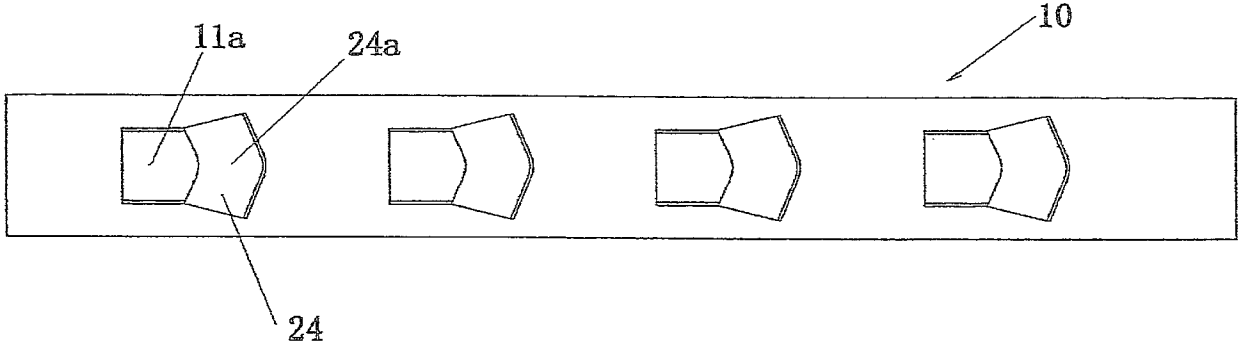
FIG. 3*b* is an enlarged schematic sectional view of the refrigerant guiding pipe according to an embodiment of the present invention.

FIGS. 3*a* and 3*b* show a refrigerant guiding pipe 10 according to an embodiment of the present invention. The structure of the refrigerant guiding pipe 10 according to this embodiment may be substantially the same as that of the refrigerant guiding pipe 10 according FIG. 2 except as described below.

As illustrated in FIGS. 3*a* and 3*b*, the protruded wall section 24 is bent from the pipe wall 17 at an angle of more than 90 degrees relative to the pipe wall 17. Except for the second end 242 connected with the pipe wall 17, the other edges of the protruded wall section 24 are separated from the pipe wall 17, thereby forming the opening 11*a*. The protruded wall section 24 constitutes an example of the refrigerant guiding wall portion.

Figure 4A:
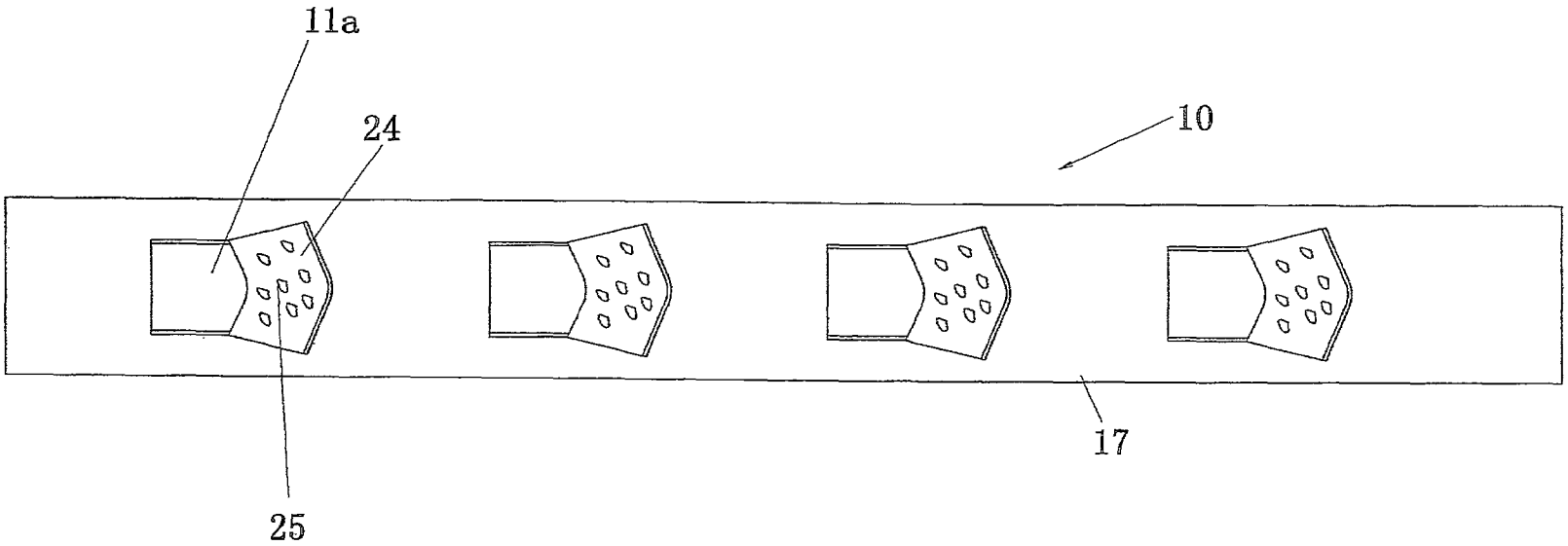
FIG. 4*a* is a schematic view of a refrigerant guiding pipe according to an embodiment of the present invention.
Figure 4B:
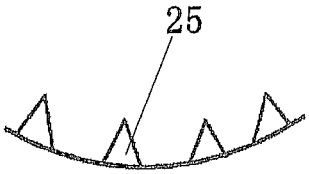
FIGS. 4*b* and 4*c* are partially enlarged schematic views of the refrigerant guiding pipe according to an embodiment.
Figure 4C:
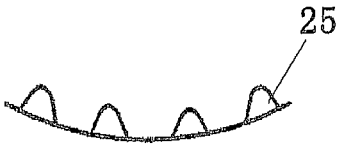

FIGS. 4*a*, 4*b* and 4*c* show structure of a refrigerant guiding pipe 10 according to an embodiment of the present invention. As illustrated in FIGS. 4*a*, 4*b* and 4*c*, the refrigerant guiding pipe 10 differs from the refrigerant guiding pipe 10 of FIG. 3 in that a plurality of protrusions 25 are disposed on a surface of the protruded wall section 24 facing the opening 11*a*. The plurality of protrusions 25 can disturb refrigerant when the refrigerant is ejected from the opening, so that the two phase refrigerant mixes more uniformly. The protrusions 25 may have a pointed top as illustrated in FIG. 4*b*, or a rounded top as illustrated in FIG. 4*c*.

Figure 5A:
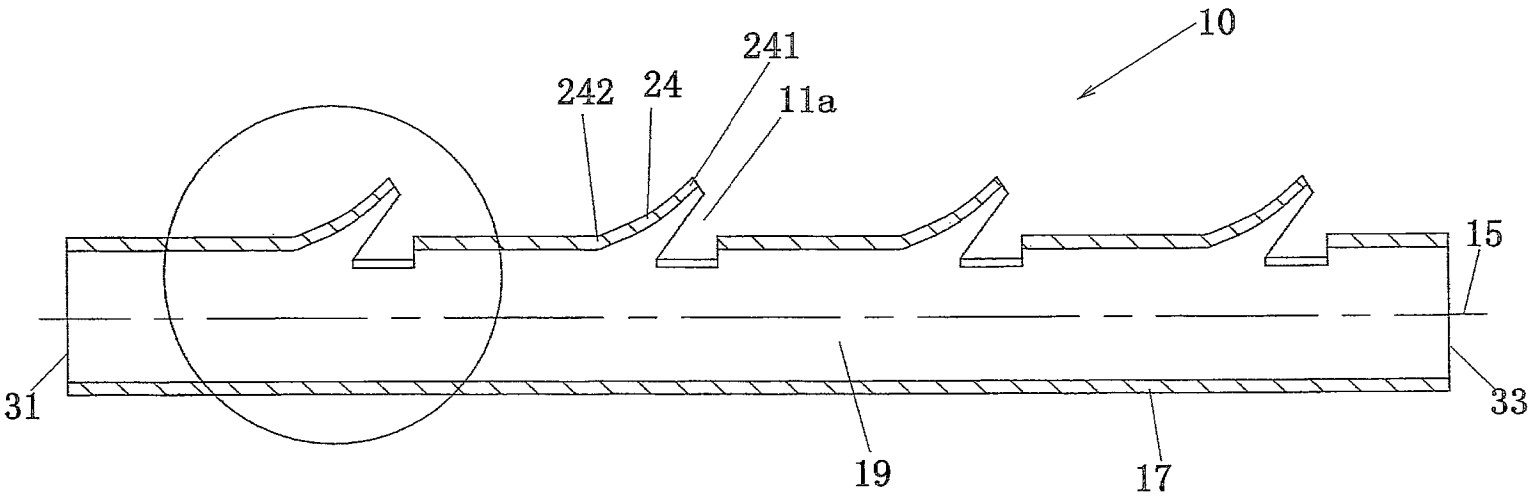
FIG. 5*a* is a schematic sectional view of a refrigerant guiding pipe according to an embodiment of the present invention.
Figure 5B:
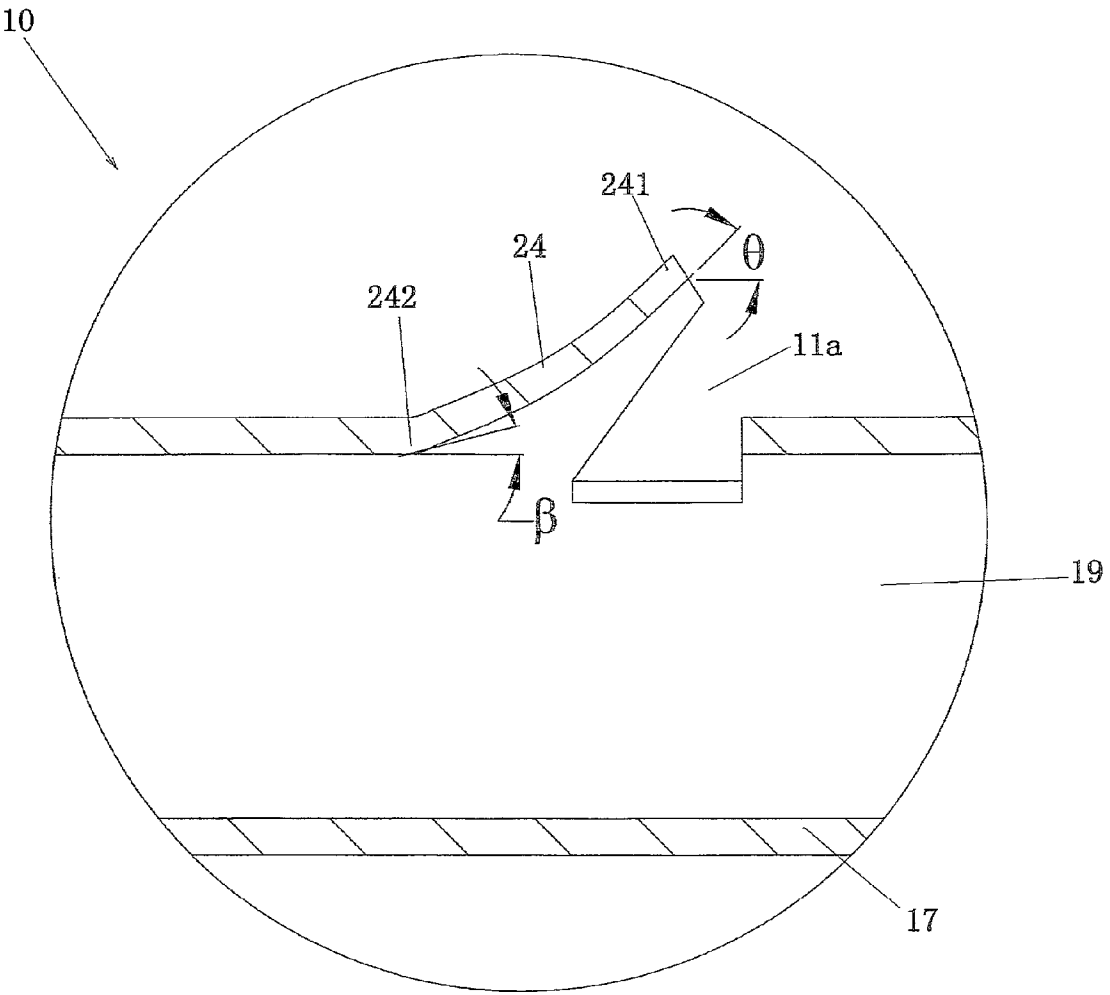
FIG. 5*b* is a schematic view of the refrigerant guiding pipe according to an embodiment of the present invention.

FIGS. 5*a* and 5*b* show schematic views of a refrigerant guiding pipe 10 according to an embodiment of the present invention. The refrigerant guiding pipe 10 according to this embodiment may be the same as the refrigerant guiding pipe 10 of FIG. 2 except as described hereafter.

As illustrated in FIGS. 5*a* and 5*b* and referring to FIGS. 2*a*-2*d*, in the refrigerant guiding pipe 10 of this embodiment, at least the middle portion 24*a* of the protruded wall section 24 in the direction perpendicular to the axial direction of the refrigerant guiding pipe 10 has a section along the axial direction of the refrigerant guiding pipe 10, and the section is composed of a plurality of substantially straight line-shaped segments or a plurality of substantially straight segments; or the protruded wall section 24 has a section along the axial direction of the refrigerant guiding pipe 10, and the section is composed of a plurality of substantially straight line-shaped segments or a plurality of substantially straight segments. The middle portion 24*a* extends from the first end 241 to the second end 242 in the axial direction of the refrigerant guiding pipe 10. Alternatively, at least the middle portion 24*a* of the protruded wall section 24 in the direction perpendicular to the axial direction of the refrigerant guiding pipe 10 has a section along the axial direction of the refrigerant guiding pipe 10, and the section is composed of an arc-like segment; or the protruded wall section 24 has a section along the axial direction of the refrigerant guiding pipe 10, and the section is composed of an arc-like segment.

An angle between at least the middle portion 24*a* of the protruded wall section 24 in the direction perpendicular to the axial direction of the refrigerant guiding pipe 10 and the axial direction of the refrigerant guiding pipe 10 may gradually decrease from the first end 241 to the second end 242, or an angle between the protruded wall section 24 and the axial direction of the refrigerant guiding pipe 10 may gradually decrease from the first end 241 to the second end 242.

At the middle portion 24*a* of the protruded wall section 24, an angle β between the second end 242 of the protruded wall section 24 and the axial direction of the refrigerant guiding pipe may be larger than 0 degree and less than 45 degrees and an angle θ between the first end 241 of the protruded wall section 24 and the axial direction of the refrigerant guiding pipe may be larger than 45 degrees and less than 90 degrees. Alternatively, at the protruded wall section 24, an angle β between the second end 242 of the protruded wall section 24 and the axial direction of the refrigerant guiding pipe may be larger than 0 degree and less than 45 degrees and an angle θ between the first end 241 of the protruded wall section 24 and the axial direction of the refrigerant guiding pipe may be larger than 45 degrees and less than 90 degrees.

Alternatively, at least the middle portion 24*a* of the protruded wall section 24 in the direction perpendicular to the axial direction of the refrigerant guiding pipe 10 has a section along the axial direction of the refrigerant guiding pipe 10, and the section has substantially a shape of a curve or arc, or is substantially curved; or the protruded wall section 24 has a section along the axial direction of the refrigerant guiding pipe 10, and the section has substantially a shape of a curve or arc, or is substantially curved. The middle portion 24*a* extends from the first end 241 to the second end 242 in the axial direction of the refrigerant guiding pipe 10.

An angle between a tangent of a surface of at least the middle portion 24*a* of the protruded wall section 24 facing the opening 11*a* and the axial direction of the refrigerant guiding pipe 10 (which is referred to as "an angle between at least the middle portion 24*a* of the protruded wall section 24 and the axial direction of the refrigerant guiding pipe 10") gradually decreases from the first end 241 of the protruded wall section 24 to the second end 242 of the protruded wall section 24 opposite to the first end 241; or an angle between a tangent of a surface of the protruded wall section 24 facing the opening 11*a* and the axial direction of the refrigerant guiding pipe 10 (which is referred to as "an angle between the protruded wall section 24 and the axial direction of the refrigerant guiding pipe 10") may gradually decrease from the first end 241 of the protruded wall section 24 to the second end 242 of the protruded wall section 24 opposite to the first end 241.

At the middle portion 24*a* of the protruded wall section 24, an angle β between a tangent of a surface of the second end 242 of the protruded wall section 24 facing the opening 11*a* and the axial direction of the refrigerant guiding pipe 10 (which is referred to as "an angle between the second end 242 of the protruded wall section 24 and the axial direction of the refrigerant guiding pipe 10") may be larger than 0 degree and less than 45 degrees, and an angle θ between a tangent of a surface of the first end 241 facing the opening 11*a* and the axial direction of the refrigerant guiding pipe 10 (which is referred to as "an angle between the first end 241 and the axial direction of the refrigerant guiding pipe 10") may be larger than 45 degrees and less than 90 degrees; or at the protruded wall section 24, an angle β between a tangent of a surface of the second end 242 of the protruded wall section 24 facing the opening 11*a* and the axial direction of the refrigerant guiding pipe 10 may be larger than 0 degree and less than 45 degrees, and an angle θ between a tangent of a surface of the first end 241 facing the opening 11*a* and the axial direction of the refrigerant guiding pipe 10 may be larger than 45 degrees and less than 90 degrees.

Referring to FIG. 1, the refrigerant guiding pipe 10 may be designed such that the above angles θ and β of at least some or all of the protruded wall sections 24 may gradually increase in the direction directed from the end 31 of the refrigerant guiding pipe 10 to be connected to refrigerant piping to the other opposite end 33 of the refrigerant guiding pipe 10, that is, from the end 31 to the other end 33.

It may facilitate decrease of resistance to refrigerant flowing through the opening to configure the protruded wall section 24 in a shape of an arc or an arc-like shape. In addition, if refrigerant flows outwards from the inner chamber 19, i.e., the refrigerant guiding pipe 10 is used as a distributor, when the refrigerant flows through the opening 11*a*, the refrigerant is firstly brought into contact with the second end 242 of the protruded wall section 24, then flows along the surface of the protruded wall section 24, and finally flows out from the first end 241 of the protruded wall section 24. When the angle β is larger than 0 degree and less than 45 degrees, less resistance loss is generated when refrigerant flows through the opening, and when the angle θ is larger than 45 degrees and less than 90 degrees, a better effect of guiding and distributing refrigerant can be achieved.

An angle between a part of the curved refrigerant guiding wall portion such as the protruded wall section 24 and the axial direction of the refrigerant guiding pipe 10 is defined by an angle between a tangent line or surface of a surface of the part of the refrigerant guiding wall portion facing the opening and the axial direction of the refrigerant guiding pipe 10.

It can be appreciated from the above embodiments of the protruded wall section 24:

At least the middle portion 24*a* of the refrigerant guiding wall portion, such as the protruded wall section 24, in the direction perpendicular to the axial direction of the refrigerant guiding pipe 10 has a section along the axial direction of the refrigerant guiding pipe, the section has a shape of a substantially straight line or is substantially straight, and the middle portion 24*a* is inclined at an angle γ with respect to the axial direction of the refrigerant guiding pipe 10. Alternatively, the refrigerant guiding wall portion such as the protruded wall section 24 has a section along the axial direction of the refrigerant guiding pipe, the section has a shape of a substantially straight line or is substantially straight, and the refrigerant guiding wall portion such as the protruded wall section 24 is inclined at an angle γ with respect to the axial direction of the refrigerant guiding pipe 10. The angle γ is about more than 0 degree and less than 90 degrees, desirably in the range from about 5 degrees to about 75 degrees. The distances or pitches d1 between the adjacent openings 11*a* and between the adjacent openings 11*b* may gradually decrease in the direction directed from the end 31 of the refrigerant guiding pipe 10 to be connected to refrigerant piping to the other opposite end 33 of the refrigerant guiding pipe 10, that is, from the end 31 to the other end 33; and at least the middle portions 23*a* (see, e.g., FIGS. 9, 10 and 12) and 24*a* of at least some or all of the refrigerant guiding wall portions in the direction perpendicular to the axial direction of the refrigerant guiding pipe, or at least some or all of refrigerant guiding wall portions are inclined at the angles γ with respect to the axial direction of the refrigerant guiding pipe 10, and the inclination angles γ may gradually increase in the direction directed from the end 31 of the refrigerant guiding pipe 10 to the other opposite end 33 of the refrigerant guiding pipe 10, that is, from the end 31 to the other end 33.

Alternatively, at least the middle portion 24*a* of the refrigerant guiding wall portion in the direction perpendicular to the axial direction of the refrigerant guiding pipe 10 has a section along the axial direction of the refrigerant guiding pipe 10, and the section is composed of a plurality of substantially straight line-shaped segments or a plurality of substantially straight segments, or the section has substantially a shape of a curve or arc or is substantially curved; or the refrigerant guiding wall portion has a section along the axial direction of the refrigerant guiding pipe 10, and the section is composed of a plurality of substantially straight line-shaped segments or a plurality of substantially straight segments, or the section has substantially a shape of a curve or arc or is substantially curved. The middle portion 24*a* extends from the first end 241 to the second end 242 in the axial direction of the refrigerant guiding pipe 10.

In an embodiment, at least the middle portion 24*a* of the refrigerant guiding wall portion in the direction perpendicular to the axial direction of the refrigerant guiding pipe 10 has a section along the axial direction of the refrigerant guiding pipe 10, and the section comprises at least one of at least one substantially straight line-shaped segment and at least one substantially curve-shaped segment; or the refrigerant guiding wall portion has a section along the axial direction of the refrigerant guiding pipe, and the section comprises at least one of at least one substantially straight line-shaped segment and at least one substantially curve-shaped segment.

An angle between at least the middle portion 24*a* of the refrigerant guiding wall portion, such as the protruded wall section 24, in the direction perpendicular to the axial direction of the refrigerant guiding pipe 10 and the axial direction of the refrigerant guiding pipe 10 (including an angle between the tangent of the surface of the middle portion 24*a* facing the opening 11*a* and the axial direction of the refrigerant guiding pipe 10) may gradually increase in a direction in which the refrigerant guiding wall portion, such as the protruded wall section 24, extends outside the inner chamber 19 of the refrigerant guiding pipe 10 from a side of the inner chamber 19 of the refrigerant guiding pipe 10; or an angle between the refrigerant guiding wall portion such as the protruded wall section 24 and the axial direction of the refrigerant guiding pipe 10 (including an angle between the tangent of the surface of the refrigerant guiding wall portion, such as the protruded wall section 24, facing the opening 11*a* and the axial direction of the refrigerant guiding pipe 10) may gradually increase in a direction in which the refrigerant guiding wall portion, such as the protruded wall section 24, extends outside the inner chamber 19 of the refrigerant guiding pipe 10 from a side of the inner chamber 19 of the refrigerant guiding pipe 10.

At at least the middle portion 24*a* of the refrigerant guiding wall portion, such as the protruded wall section 24, an angle β between the second end 242, which is close to the axis 15 of the refrigerant guiding pipe 10, of the refrigerant guiding wall portion such as the protruded wall section 24 and the axial direction of the refrigerant guiding pipe (including the angle between the tangent of the surface of the second end 242 facing the opening 11*a* and the axial direction of the refrigerant guiding pipe) may be larger than 0 degree and less than 45 degrees, and an angle θ between the first end 241, which is located far from the axis 15, of the refrigerant guiding wall portion such as the protruded wall section 24 and the axial direction of the refrigerant guiding pipe (including the angle between the tangent of the surface of the first end 241 facing the opening and the axial direction of the refrigerant guiding pipe) may be larger than 45 degrees and less than 90 degrees. Alternatively, at the refrigerant guiding wall portion, such as the protruded wall section 24, an angle β between the second end 242, which is close to the axis 15 of the refrigerant guiding pipe 10, of the refrigerant guiding wall portion such as the protruded wall section 24 and the axial direction of the refrigerant guiding pipe (including the angle between the tangent of the surface of the second end 242 facing the opening and the axial direction of the refrigerant guiding pipe) may be larger than 0 degree and less than 45 degrees, and an angle θ between the first end 241, which is located far from the axis 15, of the refrigerant guiding wall portion such as the protruded wall section 24 and the axial direction of the refrigerant guiding pipe (including the angle between the tangent of the surface of the first end 241 facing the opening and the axial direction of the refrigerant guiding pipe) may be larger than 45 degrees and less than 90 degrees.

The refrigerant guiding pipe 10 may be designed such that the above angles θ and β of at least some of the refrigerant guiding wall portions such as the protruded wall sections 24 and recessed wall sections 23 (see, e.g., FIGS. 9, 10 and 12) or all of the refrigerant guiding wall portions such as the protruded wall sections 24 may gradually increase in the direction directed from the end 31 of the refrigerant guiding pipe 10 to be connected to a refrigerant piping to the other opposite end 33 of the refrigerant guiding pipe 10, that is, from the end 31 to the other end 33.

Figures 6A, 6B, 6C:
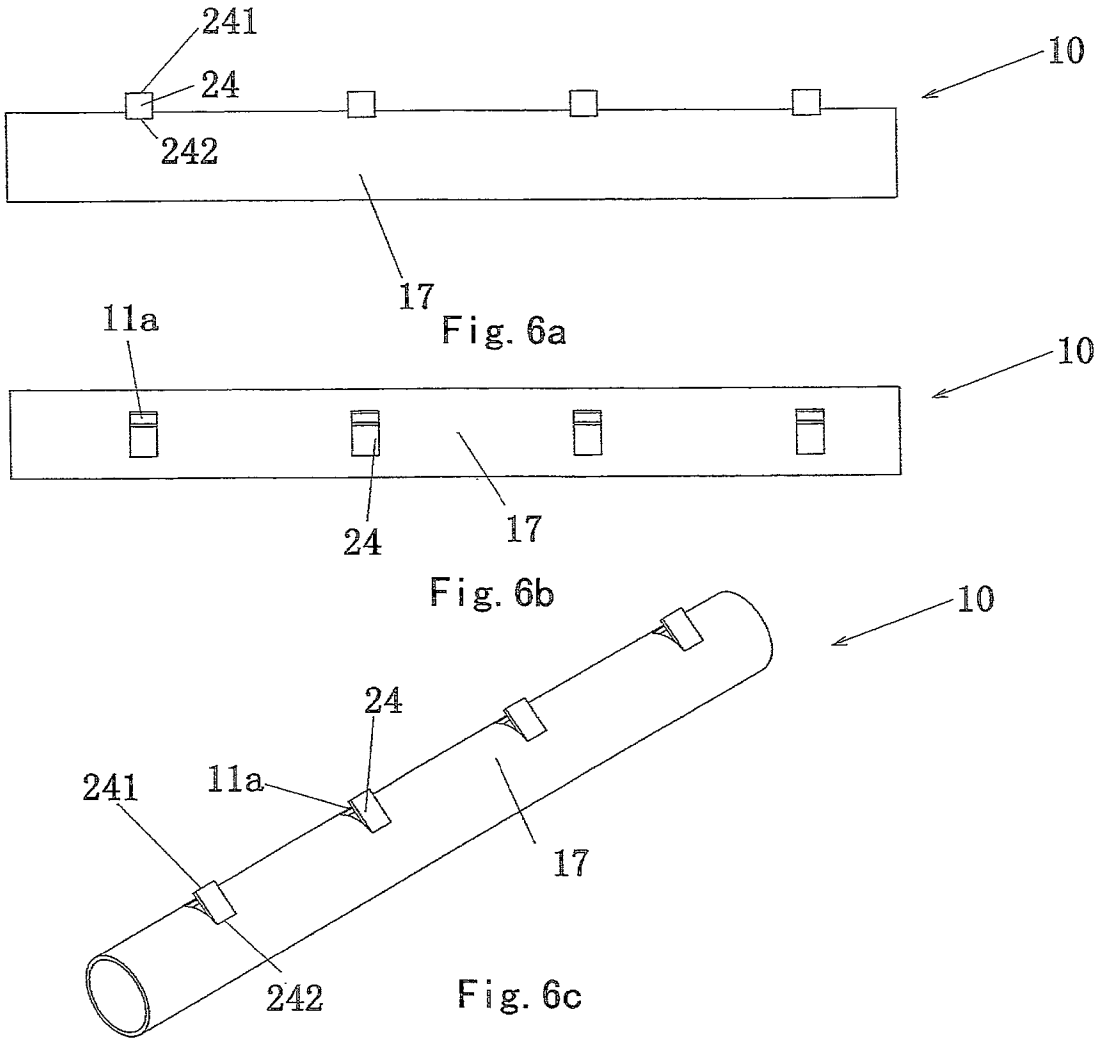
FIG. 6*a* is a schematic front view of a refrigerant guiding pipe according to an embodiment of the present invention.
FIG. 6*b* is a schematic top view of the refrigerant guiding pipe according to an embodiment of the present invention.
FIG. 6*c* is a schematic perspective view of the refrigerant guiding pipe according to an embodiment of the present invention.

FIGS. 6*a* and 6*b* show a refrigerant guiding pipe 10 according to an embodiment of the present invention. The structure of the refrigerant guiding pipe 10 according to this embodiment may employ the features of the refrigerant guiding pipe 10 according to any one of the embodiments of FIG. 2-5 except as described below. As illustrated in FIGS. 6*a*, 6*b* and 6*c*, a first end 241 of a refrigerant guiding wall portion 26 in a circumferential direction of the refrigerant guiding pipe is separated from the pipe wall 17, and a second opposite end 242 of the refrigerant guiding wall portion 26 is connected with the pipe wall 17. The protruded wall section 24 is substantially rectangular in shape. In the embodiment, the entire protruded wall section 24 may be located substantially in one plane. In other words, the entire protruded wall section 24 may have a shape of a substantially flat plate. Alternatively, a section of the protruded wall section 24 in a direction directed from the second end 242 to the first end 241 comprises at least one substantially straight line-shaped segment and/or at least one substantially curve-shaped segment.

Figure 7A:
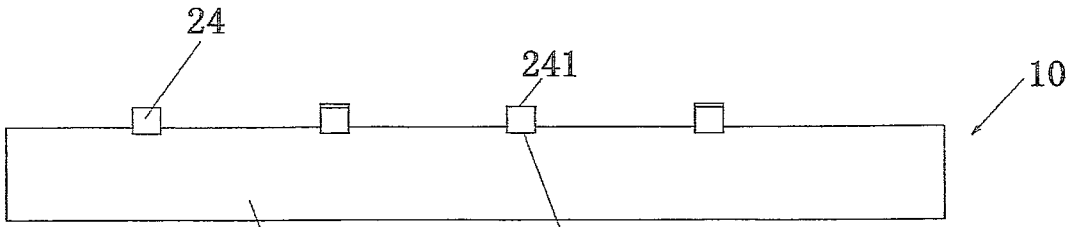
FIG. 7*a* is a schematic front view of a refrigerant guiding pipe according to an embodiment of the present invention.
Figure 7B:
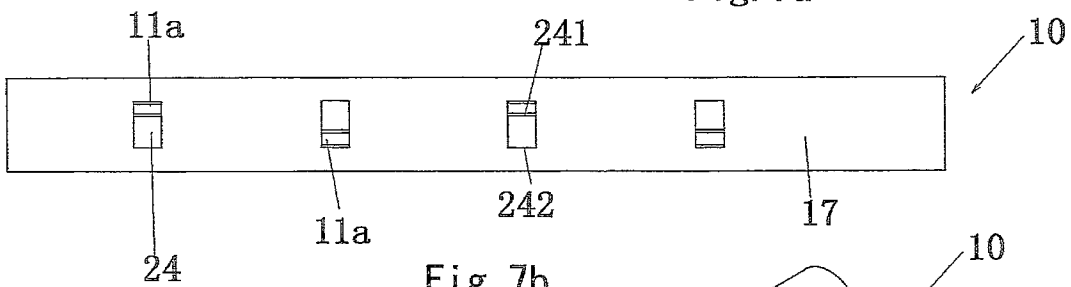
FIG. 7*b* is a schematic top view of the refrigerant guiding pipe according to an embodiment of the present invention.
Figure 7C:
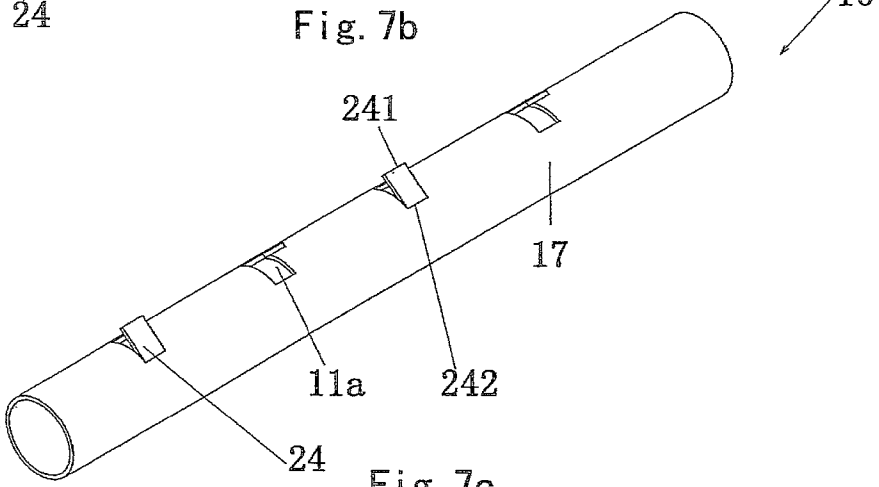
FIG. 7*c* is a schematic perspective view of the refrigerant guiding pipe according to an embodiment of the present invention.

FIGS. 7*a*, 7*b* and 7*c* show a refrigerant guiding pipe 10 according to an embodiment of the present invention. The refrigerant guiding pipe 10 according to this embodiment differs from that of the refrigerant guiding pipe 10 of FIG. 6 in that all of the first ends 241 and the second ends 242 of the protruded wall sections 24 are not positioned on the same side in a circumferential direction of the refrigerant guiding pipe 10. Rather, the protruded wall sections 24 with the second ends 242 located on a first side in the circumferential direction of the refrigerant guiding pipe 10 and the protruded wall sections 24 with the second ends 242 located on a second side opposite to the first side in the circumferential direction of the refrigerant guiding pipe 10 are alternately arranged along the axial direction of the refrigerant guiding pipe 10.

Figures 8A, 8B, 8C:
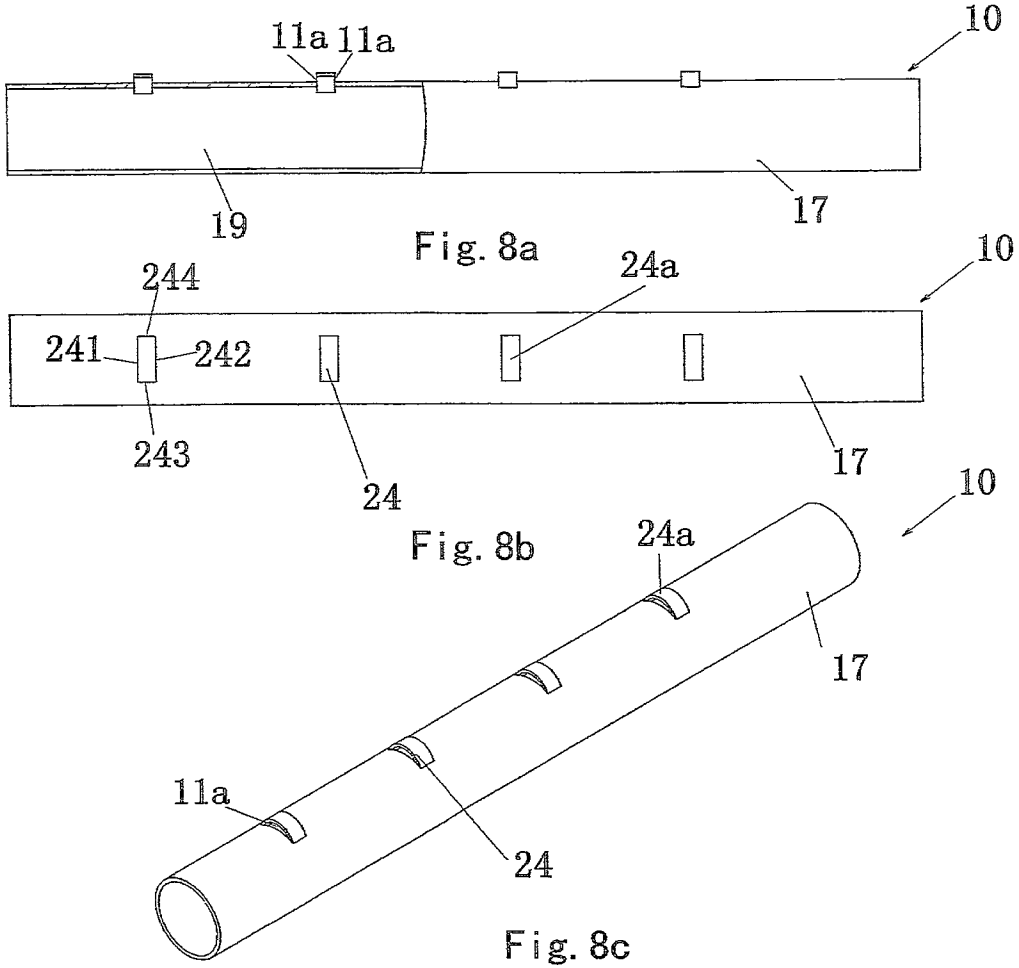
FIG. 8*a* is a schematic front view of a refrigerant guiding pipe according to an embodiment of the present invention.
FIG. 8*b* is a schematic top view of the refrigerant guiding pipe according to an embodiment of the present invention.
FIG. 8*c* is a schematic perspective view of the refrigerant guiding pipe according to an embodiment of the present invention.

FIGS. 8*a*, 8*b* and 8*c* show a refrigerant guiding pipe 10 according to an embodiment of the present invention. As illustrated in FIGS. 8*a*, 8*b* and 8*c*, a protruded wall section 24 is substantially rectangular in shape in FIGS. 8*b* and 8*c*, and ends 241 and 242 of the protruded wall section 24 opposite to each other in the axial direction of the refrigerant guiding pipe 10 are separated from the pipe wall 17 to form openings 11*a* opposite to each other in the axial direction, and ends 243 and 244 of the protruded wall section 24 opposite to each other in the circumferential direction of the refrigerant guiding pipe 10 are connected with the pipe wall 17. A section of the protruded wall section 24 in the circumferential direction of the refrigerant guiding pipe may have substantially the shape of an arch. A section of the protruded wall section 24 in a direction directed from the first end 241 to the second end 242 comprises at least one substantially straight line-shaped segment and/or at least one substantially curve-shaped segment. Alternatively, the middle portion 24*a* of the protruded wall section 24 in the direction perpendicular to the axial direction of the refrigerant guiding pipe may have a substantially U-shaped or V-shaped section along the axial direction of the refrigerant guiding pipe. The middle portion 24*a* extends from the first end 241 to the second end 242 in the axial direction of the refrigerant guiding pipe 10.

Figure 9A:
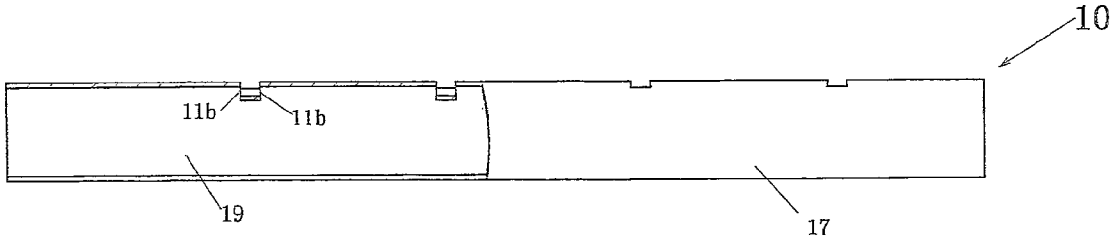
FIG. 9*a* is a schematic front view of a refrigerant guiding pipe according to an embodiment of the present invention.
Figure 9B:
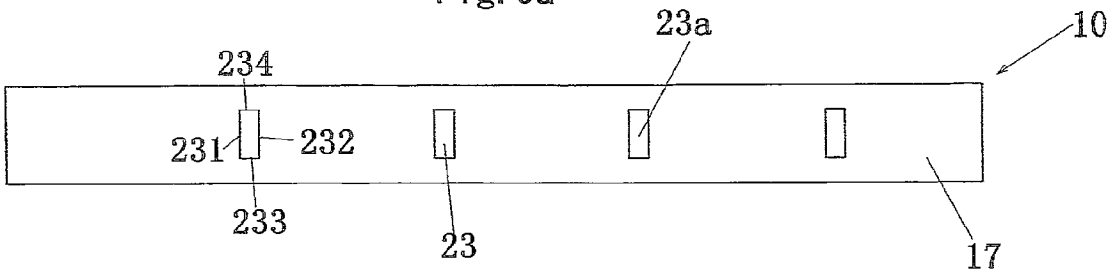
FIG. 9*b* is a schematic top view of the refrigerant guiding pipe according to an embodiment of the present invention.
Figure 9C:
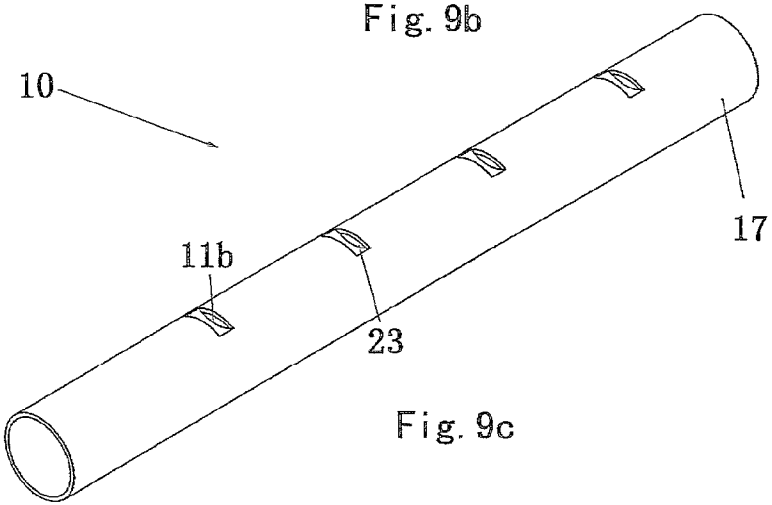
FIG. 9*c* is a schematic perspective view of the refrigerant guiding pipe according to an embodiment of the present invention.

FIGS. 9*a*, 9*b* and 9*c* show a refrigerant guiding pipe 10 according to an embodiment of the present invention. As illustrated in FIGS. 9*a*, 9*b* and 9*c*, the refrigerant guiding pipe 10 comprises a recessed wall section 23, the recessed wall section 23 is substantially rectangular in shape in FIGS. 9*b* and 9C, and ends 231 and 232 of the recessed wall section 23 opposite to each other in the axial direction of the refrigerant guiding pipe 10 are separated from the pipe wall 17 to form openings 11*b* opposite to each other in the axial direction, and ends 233 and 234 of the recessed wall section 23 opposite to each other in the circumferential direction of the refrigerant guiding pipe 10 are connected with the pipe wall 17. A section of the recessed wall section 23 in the circumferential direction of the refrigerant guiding pipe may have substantially the shape of an arch. A section of the recessed wall section 23 in a direction directed from the first end 231 to the second end 232 comprises at least one substantially straight line-shaped segment and/or at least one substantially curve-shaped segment. Alternatively, the middle portion 23*a* of the recessed wall section 23 in the direction perpendicular to the axial direction of the refrigerant guiding pipe may have a substantially inverted U-shaped or inverted V-shaped section along the axial direction of the refrigerant guiding pipe. The middle portion 23*a* extends from the first end 231 to the second end 232 in the axial direction of the refrigerant guiding pipe 10.

FIGS. 10*a*, 10*b* and 10*c* show a refrigerant guiding pipe 10 according to an embodiment of the present invention. As illustrated in FIGS. 10*a*, 10*b* and 10*c*, the refrigerant guiding pipe 10 comprises a recessed wall section 23, and the recessed wall section 23 is substantially rectangular in shape in FIGS. 10*b* and 10*c*. Ends 231 and 232 of the recessed wall section 23 opposite to each other in the axial direction of the refrigerant guiding pipe 10 are connected with the pipe wall 17, and ends 233 and 234 of the recessed wall section 23 opposite to each other in the circumferential direction of the refrigerant guiding pipe 10 are separated from the pipe wall 17 to form openings 11*b* opposite to each other in the circumferential direction of the refrigerant guiding pipe 10. The recessed wall section 23 may have a substantially U-shaped or V-shaped section along the axial direction of the refrigerant guiding pipe.

Figure 11A:
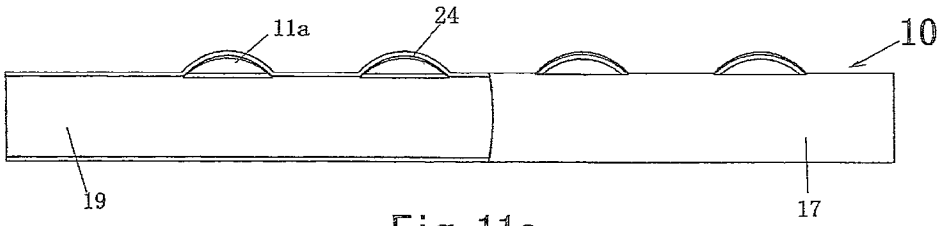
FIG. 11*a* is a schematic front view of a refrigerant guiding pipe according to an embodiment of the present invention.
Figure 11B:
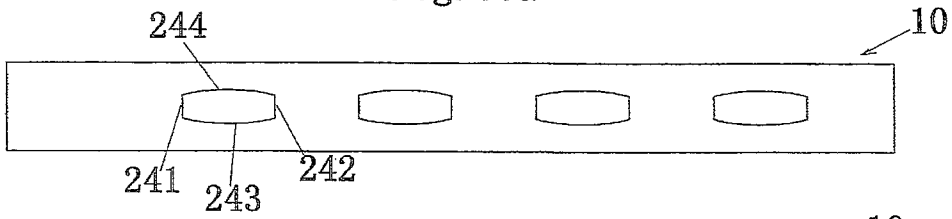
FIG. 11*b* is a schematic top view of the refrigerant guiding pipe according to an embodiment of the present invention.
Figure 11C:
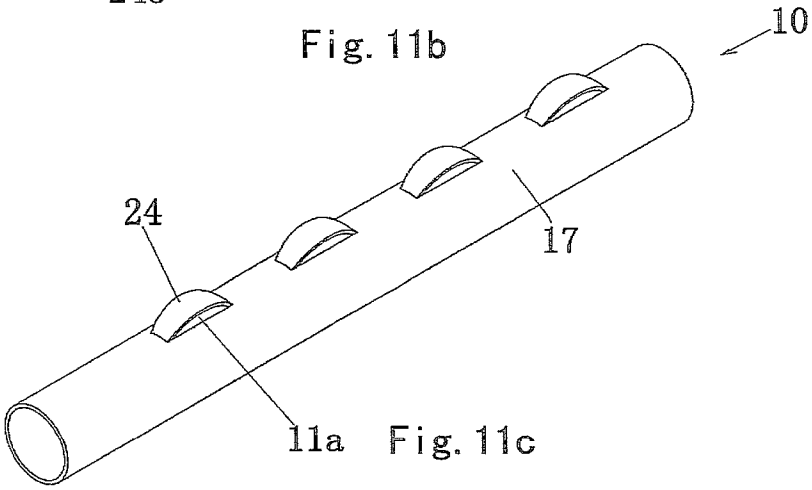
FIG. 11*c* is a schematic perspective view of the refrigerant guiding pipe according to an embodiment of the present invention.

FIGS. 11*a*, 11*b* and 11*c* show a refrigerant guiding pipe 10 according to an embodiment of the present invention. As illustrated in FIGS. 11*a*, 11*b* and 11*c*, the refrigerant guiding pipe 10 comprises a protruded wall section 24, and the protruded wall section 24 is substantially quadrangular in shape in FIGS. 11*b* and 11*c*. Ends 241 and 242 of the protruded wall section 24 opposite to each other in the axial direction of the refrigerant guiding pipe 10 are connected with the pipe wall 17, and ends 243 and 244 of the protruded wall section 24 opposite to each other in the circumferential direction of the refrigerant guiding pipe 10 are separated from the pipe wall 17 to form openings 11*a* opposite to each other in the circumferential direction of the refrigerant guiding pipe 10. The protruded wall section 24 may have a substantially inverted U-shaped or inverted V-shaped section along the axial direction of the refrigerant guiding pipe.

Figure 12A:
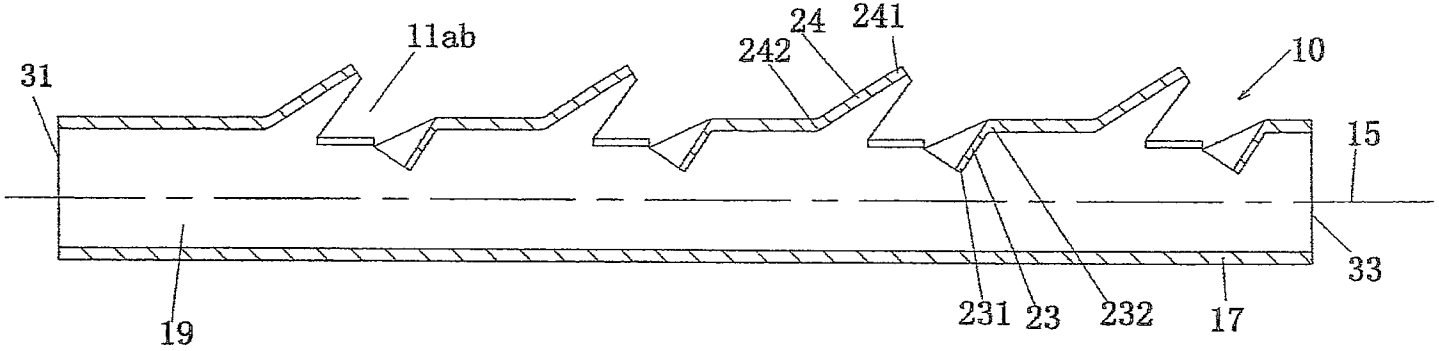
FIG. 12*a* is a schematic sectional view of a refrigerant guiding pipe according to an embodiment of the present invention.
Figure 12B:
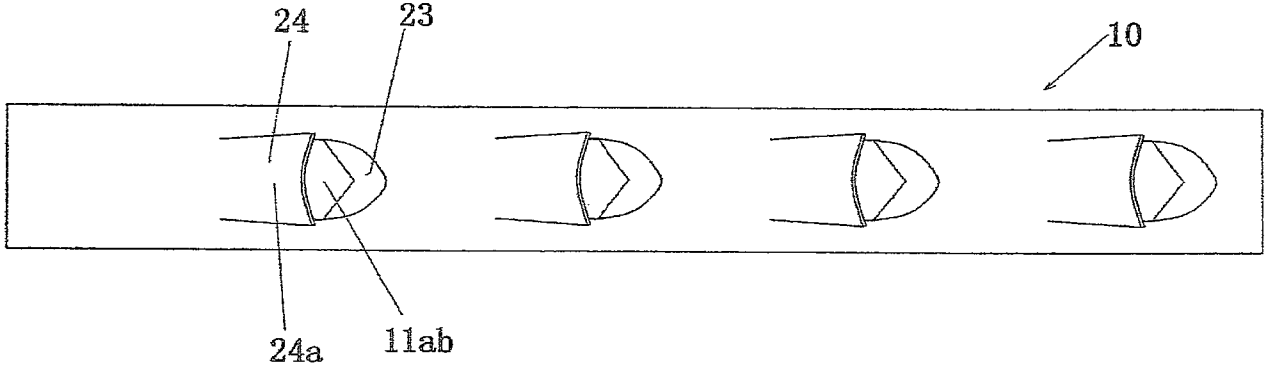
FIG. 12*b* is a schematic view of the refrigerant guiding pipe according to an embodiment of the present invention.

FIGS. 12*a* and 12*b* show a refrigerant guiding pipe 10 according to an embodiment of the present invention. The structure of the refrigerant guiding pipe 10 according to this embodiment may be substantially the same as that of the refrigerant guiding pipe 10 according to FIGS. 2-5 except as described below.

As illustrated in FIGS. 12*a* and 12*b*, the refrigerant guiding pipe 10 comprises a protruded wall section 24 projected outside the inner chamber 19, and a recessed wall section 23 depressed towards the inner chamber 19. At least a first end 241 of the protruded wall section 19 in the axial direction of the refrigerant guiding pipe 10 and a first end 231 of the recessed wall section 23 in the axial direction of the refrigerant guiding pipe 10 are separated from each other, thereby forming the opening 11*ab*. Alternatively, the first end 241 of the protruded wall section 24 and the first end 231 of the recessed wall section 23 may be spaced from each other by a predetermined distance prior to processing the protruded wall section 24 and the recessed wall section 23, and at least the first end 241 of the protruded wall section 24 in the axial direction of the refrigerant guiding pipe 10 is separated from the pipe wall 17, thereby forming the opening 11*ab*, and at least the first end 231 of the recessed wall section 23 in the axial direction of the refrigerant guiding pipe 10 is separated from the pipe wall 17, thereby forming the opening 11*ab*.

In the above embodiments, at least the first ends 241 and 231 are separated from the pipe wall 17, or the first ends 241 and 231 are separated from each other. Alternatively, at least a part of edge of the protruded wall section 24 and at least a part of edge of the recessed wall section 23 may be separated from the pipe wall 11, or at least a part of edge of the protruded wall section 24 and at least a part of edge of the recessed wall section 23 may be separated from each other.

The protruded wall section 24 and the recessed wall section 23 according to the above embodiments constitute examples of the refrigerant guiding wall portion.

In the above embodiments, refrigerant flows along the inner chamber of the refrigerant guiding pipe, and the refrigerant guiding wall portion mainly functions to guide the refrigerant. Refrigerant is ejected to the inner cavity of the manifold along the refrigerant guiding wall portion, and mixed in the manifold so that gaseous refrigerant and liquid refrigerant are uniformly mixed and do not layer.

The structures described in the above embodiments may be appropriately combined to form new embodiments. Features in one embodiment may also be applicable to the other embodiments or substitute for those of the other embodiments. For example, the protrusion described in FIG. 6 may be applied to the other embodiments.

Although the embodiments of the present invention have been described with reference to the drawings, the embodiments shown in the drawings are intended to illustrate the preferable embodiments of the present invention and shall not be construed to limit the present invention.

For example, the opening and the refrigerant guiding wall portion such as the protruded wall section and the recessed wall section have symmetrical structures in the above embodiments. Alternatively, the opening and the refrigerant guiding wall portion such as the protruded wall section and the recessed wall section may have asymmetrical structures in the above embodiments. For example, when the refrigerant guiding pipe is made of a circular pipe, the opening and the refrigerant guiding wall portion such as the protruded wall section and the recessed wall section may be symmetrical or asymmetrical about a plane passing through a center axis of the refrigerant guiding pipe.

In addition, in the above embodiments, the examples of the refrigerant guiding wall portion are the protruded wall section and/or the recessed wall section. However, the refrigerant guiding wall portion is not limited to the protruded wall section and/or the recessed wall section. Refrigerant passing through the opening may be guided in other appropriate ways. For example, a separate refrigerant guiding wall portion such as a guide pipe and a guide element may be soldered to the refrigerant guiding pipe in the vicinity of the opening, or to an inside or outside of the refrigerant guiding pipe to guide refrigerant passing through the opening. In addition, the opening may have any appropriate shape and the refrigerant guiding wall portion may have any appropriate shape and structure.

Furthermore, in the above embodiments, the end of the refrigerant guiding wall portion is separated from the pipe wall, thereby forming the opening. However, the present invention is not limited to this. Alternatively, the refrigerant guiding wall portion may be separated from the pipe wall at any position, thereby forming the opening; or the refrigerant guiding wall portion may be separated from the pipe wall at any edge of the refrigerant guiding wall portion, thereby forming the opening.

In addition, the refrigerant guiding wall portion may have any appropriate shape such as a semicircular shape or a triangular shape.

What is claimed is:

1. A refrigerant guiding pipe for a heat exchanger, the refrigerant guiding pipe comprising:

a pipe wall in which an inner chamber is formed;

an opening formed in the pipe wall; and a refrigerant guiding wall portion, wherein at least a part of the refrigerant guiding wall portion is radially separated from the pipe wall, the at least part of the refrigerant guiding wall portion defining at least in part the opening and the at least part of the refrigerant guiding wall portion comprising a protruded wall section projecting from the pipe wall in a direction outward from the inner chamber, where at least a part of the refrigerant guiding wall portion is disposed to be inclined with respect to the axial direction of the refrigerant guiding pipe to guide refrigerant passing through the opening, where the refrigerant guiding wall portion has a first end, has a second end closer to an axis of the refrigerant guiding pipe than the first end, and has a middle portion, where at least the middle portion of the refrigerant guiding wall portion in the direction perpendicular to the axial direction of the refrigerant guiding pipe, or at the refrigerant guiding wall portion, a first angle between the second end of the refrigerant guiding wall portion and the axial direction of the refrigerant guiding pipe is larger than 0 degree and less than 45 degrees, and a second angle between the first end of the refrigerant guiding wall portion and the axial direction of the refrigerant guiding pipe is larger than 45 degree and less than 90 degrees.

2. The refrigerant guiding pipe of claim 1, wherein at least the middle portion of the refrigerant guiding wall portion in a direction perpendicular to the axial direction of the refrigerant guiding pipe is inclined with respect to the axial direction of the refrigerant guiding pipe, at least a portion of the refrigerant guiding wall portion is inclined with respect to the axial direction of the refrigerant guiding pipe, or the refrigerant guiding wall portion is inclined with respect to the axial direction of the refrigerant guiding pipe.

3. The refrigerant guiding pipe of claim 1, wherein at least the middle portion of the refrigerant guiding wall portion in a direction perpendicular to the axial direction of the refrigerant guiding pipe has a section along the axial direction of the refrigerant guiding pipe, and the section has a shape of an essentially straight line, or is essentially straight; or the refrigerant guiding wall portion has a section along the axial direction of the refrigerant guiding pipe, and the section has a shape of an essentially straight line, or is essentially straight.

4. The refrigerant guiding pipe of claim 3, wherein at least the middle portion of the refrigerant guiding wall portion in the direction perpendicular to the axial direction of the refrigerant guiding pipe is positioned at a third angle of more than zero degree and less than 90 degrees with respect to the axial direction of the refrigerant guiding pipe, or the refrigerant guiding wall portion is positioned at a third angle of more than zero degree and less than 90 degrees with respect to the axial direction of the refrigerant guiding pipe.

5. The refrigerant guiding pipe of claim 2, wherein at least the middle portion of the refrigerant guiding wall portion in the direction perpendicular to the axial direction of the refrigerant guiding pipe has a section along the axial direction of the refrigerant guiding pipe, and the section comprises at least one essentially curve-shaped segment, or a section of the refrigerant guiding wall portion along the axial direction of the refrigerant guiding pipe comprises at least one essentially curve-shaped segment.

6. The refrigerant guiding pipe of claim 5, wherein the refrigerant guiding wall portion is configured such that an angle between at least the middle portion of the refrigerant guiding wall portion in the direction perpendicular to the axial direction of the refrigerant guiding pipe and the axial direction of the refrigerant guiding pipe, or an angle between the refrigerant guiding wall portion and the axial direction of the refrigerant guiding pipe, gradually increases in a direction in which the refrigerant guiding wall portion extends outside the inner chamber of the refrigerant guiding pipe from a side of the inner chamber of the refrigerant guiding pipe.

7. The refrigerant guiding pipe of claim 1, wherein a plurality of protrusions are disposed on a surface of the refrigerant guiding wall portion facing the opening.

8. The refrigerant guiding pipe of claim 4, further comprising:

a first end of the refrigerant guiding pipe to be connected with refrigerant piping, and a second end of the refrigerant guiding pipe opposite to the first end, wherein the third angle of at least some or all of the refrigerant guiding wall portions gradually increases in a direction directed from the first end of the refrigerant guiding pipe to the second end of the refrigerant guiding pipe.

9. The refrigerant guiding pipe of claim 1, further comprising:

a first end of the refrigerant guiding pipe to be connected with refrigerant piping, and a second end of the refrigerant guiding pipe opposite to the first end, wherein a pitch of a plurality of openings formed in the pipe wall gradually decreases in a direction directed from the first end of the refrigerant guiding pipe to the second end of the refrigerant guiding pipe.

10. The refrigerant guiding pipe of claim 1, wherein at least an end of the refrigerant guiding wall portion in the axial direction of the refrigerant guiding pipe is separated from the pipe wall.

11. The refrigerant guiding pipe of claim 1, wherein at least an end of the refrigerant guiding wall portion in a circumferential direction of the refrigerant guiding pipe is separated from the pipe wall.

12. The refrigerant guiding pipe of claim 1, wherein the first end of the refrigerant guiding wall portion in a circumferential direction of the refrigerant guiding pipe is separated from the pipe wall, and the second end of the refrigerant guiding wall portion opposite to the first end is connected with the pipe wall.

13. The refrigerant guiding pipe of claim 12, wherein refrigerant guiding wall portions with second ends located on a first side in the circumferential direction of the refrigerant guiding pipe and refrigerant guiding wall portions with second ends located on a second side opposite to the first side in the circumferential direction of the refrigerant guiding pipe are alternately arranged along the axial direction of the refrigerant guiding pipe.

14. The refrigerant guiding pipe of claim 1, wherein ends of the refrigerant guiding wall portion opposite to each other in a circumferential direction of the refrigerant guiding pipe are separated from the pipe wall.

15. The refrigerant guiding pipe of claim 1, wherein ends of the refrigerant guiding wall portion opposite to each other in the axial direction of the refrigerant guiding pipe are separated from the pipe wall.

16. The refrigerant guiding pipe of claim 1, wherein the refrigerant guiding wall portion further comprises a recessed wall section depressed towards the inner chamber.

17. A heat exchanger, comprising:

a first manifold;

a second manifold spaced away from the first manifold by a certain distance;

a heat exchange tube having two ends respectively connected with the first manifold and the second manifold; and a refrigerant guiding pipe, comprising:

a pipe wall in which an inner chamber is formed, an opening formed in the pipe wall, and a refrigerant guiding wall portion, wherein at least a part of the refrigerant guiding wall portion is radially separated from the pipe wall, the at least part of the refrigerant guiding wall portion defining at least in part the opening and the at least part of the refrigerant guiding wall portion comprising a protruded wall section projecting from the pipe wall in a direction outward from the inner chamber, where at least a part of the refrigerant guiding wall portion is disposed to be inclined with respect to the axial direction of the refrigerant guiding pipe to guide refrigerant passing through the opening, where the refrigerant guiding wall portion has a first end, has a second end closer to an axis of the refrigerant guiding pipe than the first end, and has a middle portion, where at least the middle portion of the refrigerant guiding wall portion in the direction perpendicular to the axial direction of the refrigerant guiding pipe, or at the refrigerant guiding wall portion, a first angle between the second end of the refrigerant guiding wall portion and the axial direction of the refrigerant guiding pipe is larger than 0 degree and less than 45 degrees, and a second angle between the first end of the refrigerant guiding wall portion and the axial direction of the refrigerant guiding pipe is larger than 45 degree and less than 90 degrees, wherein the first manifold and/or the second manifold has the refrigerant guiding pipe therein.

18. The heat exchanger of claim 17, wherein the opening is arranged such that an imaginary line extending perpendicularly to an axial direction of the refrigerant guiding pipe passes through the opening and past the refrigerant guiding wall portion without intersecting the protruded wall section.

19. The heat exchanger of claim 17, wherein the refrigerant guiding wall portion further comprises a recessed wall section depressed towards the inner chamber.

20. The refrigerant guiding pipe of claim 1, wherein the opening is arranged such that an imaginary line extending perpendicularly to an axial direction of the refrigerant guiding pipe passes through the opening and past the refrigerant guiding wall portion without intersecting the protruded wall section.

* * * * *